US006257101B1

(12) United States Patent
Marlette et al.

(10) Patent No.: US 6,257,101 B1
(45) Date of Patent: Jul. 10, 2001

(54) ADJUSTABLE HINGE ADJUSTMENT TOOL

(76) Inventors: Allan R. Marlette, 205 W. South Channel Dr., Round Lake Beach, IL (US) 60037; David T. Wietrzak, Box 251, Wilmot, WI (US) 53192

( * ) Notice: Subject to any disclaimer, the term of this patent is extended or adjusted under 35 U.S.C. 154(b) by 0 days.

(21) Appl. No.: 09/428,853

(22) Filed: Oct. 28, 1999

(51) Int. Cl.[7] ..... B25B 13/14

(52) U.S. Cl. ..... 81/165; 81/170; 81/186; 81/426.5

(58) Field of Search ..... 81/165–167, 170, 81/186, 424.5, 426.5

(56) References Cited

U.S. PATENT DOCUMENTS

| | | | | |
|---|---|---|---|---|
| 827,254 | * | 7/1906 | Mills | 81/186 |
| 2,102,287 | * | 12/1937 | Smethers | 81/167 X |
| 2,445,969 | * | 7/1948 | Powell | 81/165 X |
| 2,849,908 | * | 9/1958 | Swanstrom et al. | 81/165 |
| 3,190,154 | * | 6/1965 | Chapman | 81/165 X |
| 3,580,115 | * | 5/1971 | Thompson | 81/165 |
| 5,305,669 | * | 4/1994 | Kimbro et al. | 81/426.5 X |

* cited by examiner

*Primary Examiner*—D. S. Meislin

(57) ABSTRACT

A adjustable hinge adjustment tool for adjusting variable sized hinges. The adjustable hinge adjustment tool includes a handle portion and a wrench head portion. The handle portion is an elongate member having a distal end and a proximal end. The proximal end is fixedly coupled to the head portion. The head portion comprises a first portion and a second portion. The first portion is fixedly coupled to the proximal end of the handle portion. A notch is in the first portion of the head portion. The second portion of the wrench comprises a base, a fixed jaw and a movable jaw. The base is fixedly coupled to the first portion of the head portion. The fixed jaw is fixedly coupled to the base. A guide slot in the base defines a track for the movable jaw. The guide slot extends into the notch. The movable jaw has a bottom member adapted to be inserted into the guide slot. The bottom member has V-shaped recesses therein. A drive worm screw is rotatably mounted in the notch. The V-shaped recesses are directed toward and are in contact with the drive worm screw. The fixed jaw and the adjustable jaw have concave inner surfaces such that when the adjustable jaw is brought to a location generally adjacent to the fixed jaw, a generally annular bore is defined.

1 Claim, 1 Drawing Sheet

ADJUSTABLE HINGE ADJUSTMENT TOOL

BACKGROUND OF THE INVENTION

1. Field of the Invention

The present invention relates to tools and more particularly pertains to a new adjustable hinge adjustment tool for adjusting variable sized hinges.

2. Description of the Prior Art

The use of tools is known in the prior art. More specifically, tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,435,030; U.S. Pat. No. 5,305,667; U.S. Pat. No. 5,595,098; U.S. Pat. No. 4,555,929; U.S. Pat. No. 3,332,274; and U.S. Pat. No. 3,965,720; U.S. Pat. Des. No. 113,665.

While these devices fulfill their respective, particular objectives and requirements, the aforementioned patents do not disclose a new adjustable hinge adjustment tool. The inventive device includes a handle portion and a wrench head portion. The handle portion is an elongate member having a distal end and a proximal end, wherein the proximal end is fixedly coupled to the head portion. The head portion comprises a first portion and a second portion. The first portion is fixedly coupled to the proximal end of the handle portion. A notch for receiving, a drive worm screw is in the first portion of the head portion. The second portion of the wrench comprises a base, a fixed jaw and a movable jaw. The base is fixedly coupled to the first portion of the head portion. The fixed jaw is fixedly coupled to the base and extends away from the handle. A guide slot in the base defines a track for the movable jaw. The guide slot extends into the notch. The movable jaw has a bottom member thereon adapted to be inserted into the guide slot. The bottom member of the movable jaw has V-shaped recesses therein. The drive worm screw is rotatably mounted in the notch and has a width larger than a depth of the notch such that a peripheral edge of the drive worm screw extends into the slot. The V-shaped recesses are directed toward and are in contact with the drive worm screw. The fixed jaw and the adjustable jaw have concave inner surfaces such that when the adjustable jaw is brought to a location generally adjacent to the fixed jaw, a generally annular bore is defined.

In these respects, the adjustable hinge adjustment tool according to the present invention substantially departs from the conventional concepts and designs of the prior art, and in so doing provides an apparatus primarily developed for the purpose of adjusting variable sized hinges.

SUMMARY OF THE INVENTION

In view of the foregoing disadvantages inherent in the known types of tools now present in the prior art, the present invention provides a new adjustable hinge adjustment tool construction wherein the same can be utilized for adjusting variable sized hinges.

The general purpose of the present invention, which will be described subsequently in greater detail, is to provide a new adjustable hinge adjustment tool apparatus and method which has many of the advantages of the tools mentioned heretofore and many novel features that result in a new adjustable hinge adjustment tool which is not anticipated, rendered obvious, suggested, or even implied by any of the prior art tools, either alone or in any combination thereof.

To attain this, the present invention generally comprises a handle portion and a wrench head portion. The handle portion is an elongate member having a distal end and a proximal end, wherein the proximal end is fixedly coupled to the head portion. The head portion comprises a first portion and a second portion. The first portion is fixedly coupled to the proximal end of the handle portion. A notch for receiving a drive worm screw is in the first portion of the head portion. The second portion of the wrench comprises a base, a fixed jaw and a movable jaw. The base is fixedly coupled to the first portion of the head portion. The fixed jaw is fixedly coupled to the base and extends away from the handle. A guide slot in the base defines a track for the movable jaw. The guide slot extends into the notch. The movable jaw has a bottom member thereon adapted to be inserted into the guide slot. The bottom member of the movable jaw has V-shaped recesses therein. The drive worm screw is rotatably mounted in the notch and has a width larger than a depth of the notch such that a peripheral edge of the drive worm screw extends into the slot. The V-shaped recesses are directed toward and are in contact with the drive worm screw. The fixed jaw and the adjustable jaw have concave inner surfaces such that when the adjustable jaw is brought to a location generally adjacent to the fixed jaw, a generally annular bore is defined.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable hinge adjustment tool apparatus and method which has many of the advantages of the tools mentioned heretofore and many novel features that result in a new adjustable hinge adjustment tool which is not anticipated, rendered obvious, suggested, or even implied by any of the prior art tools, either alone or in any combination thereof.

It is another object of the present invention to provide a new adjustable hinge adjustment tool which may be easily and efficiently manufactured and marketed.

It is a further object of the present invention to provide a new adjustable hinge adjustment tool which is of a durable and reliable construction.

An even further object of the present invention is to provide a new adjustable hinge adjustment tool which is susceptible of a low cost of manufacture with regard to both materials and labor, and which accordingly is then susceptible of low prices of sale to the consuming public, thereby making such adjustable hinge adjustment tool economically available to the buying public.

Still yet another object of the present invention is to provide a new adjustable hinge adjustment tool which provides in the apparatuses and methods of the prior art some of the advantages thereof, while simultaneously overcoming some of the disadvantages normally associated therewith.

Still another object of the present invention is to provide a new adjustable hinge adjustment tool for adjusting variable sized hinges.

Yet another object of the present invention is to provide a new adjustable hinge adjustment tool which includes a handle portion and a wrench head portion. The handle portion is an elongate member having a distal end and a proximal end, wherein the proximal end is fixedly coupled to the head portion. The head portion comprises a first portion and a second portion. The first portion is fixedly coupled to the proximal end of the handle portion. A notch for receiving a drive worm screw is in the first portion of the head portion. The second portion of the wrench comprises a base, a fixed jaw and a movable jaw. The base is fixedly coupled to the first portion of the head portion. The fixed jaw is fixedly coupled to the base and extends away from the handle. A guide slot in the base defines a track for the movable jaw. The guide slot extends into the notch. The movable jaw has a bottom member thereon adapted to be inserted into the guide slot. The bottom member of the movable jaw has V-shaped recesses therein. The drive worm screw is rotatably mounted in the notch and has a width larger than a depth of the notch such that a peripheral edge of the drive worm screw extends into the slot. The V-shaped recesses are directed toward and are in contact with the drive worm screw. The fixed jaw and the adjustable jaw have concave inner surfaces such that when the adjustable jaw is brought to a location generally adjacent to the fixed jaw, a generally annular bore is defined.

Still yet another object of the present invention is to provide a new adjustable hinge adjustment tool that as concave jaws which will not scratch or damage the hinge as it is adjusted.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
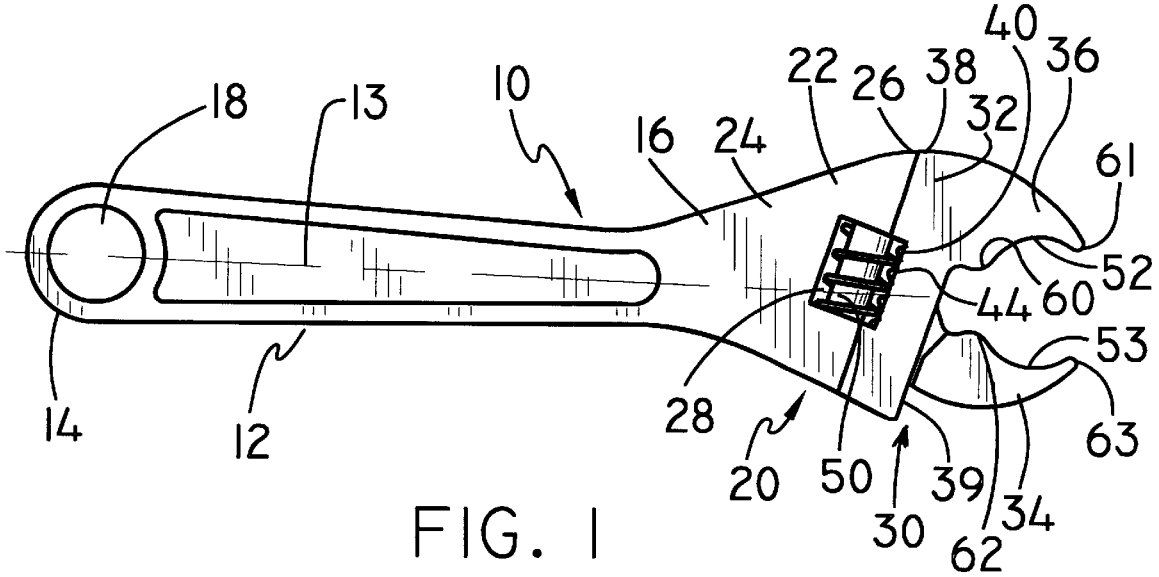
FIG. 1 is a schematic front view of a new adjustable hinge adjustment tool according to the present invention.
Figure 2:
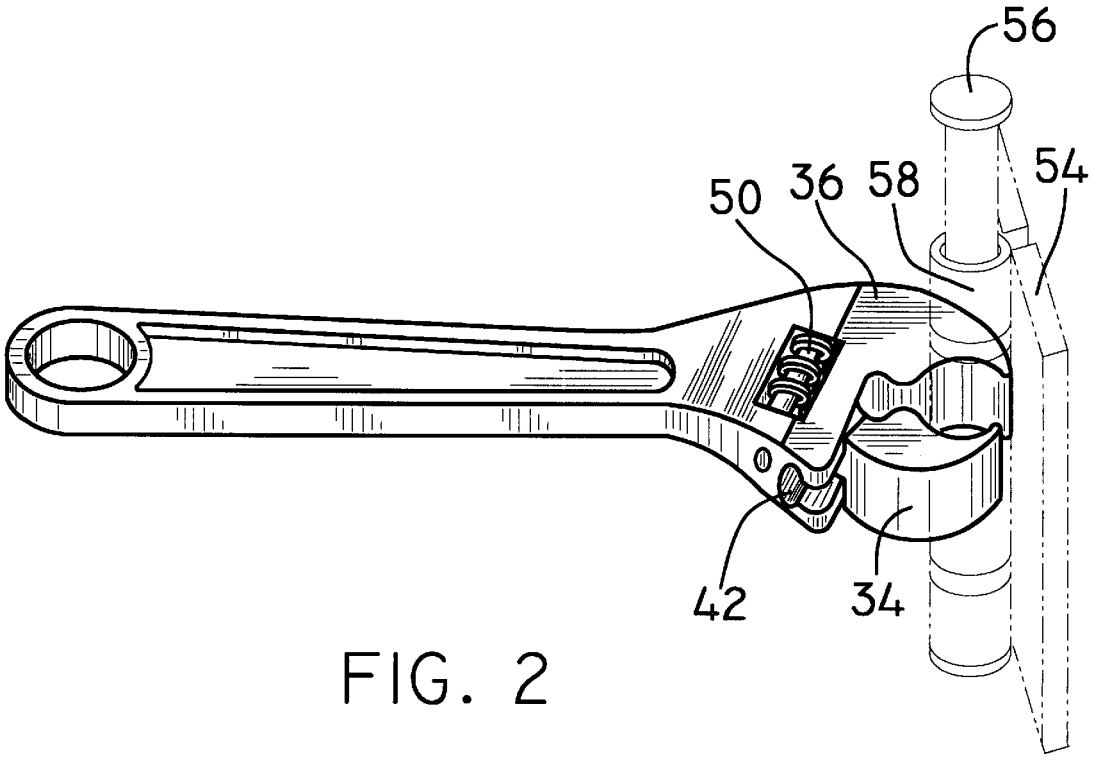
FIG. 2 is a schematic perspective view of the present invention.

With reference now to the drawings, and in particular to FIGS. 1 and 2 thereof, a new adjustable hinge adjustment tool embodying the principles and concepts of the present invention and generally designated by the reference numeral 10 will be described.

As best illustrated in FIGS. 1 and 2, the adjustable hinge adjustment tool 10 generally comprises a handle portion 12 and a wrench head portion 20. The handle and wrench head portions have a longitudinal axis 13.

The handle portion 12 is an elongate member having a distal 14 end and a proximal end 16, wherein the proximal end is fixedly coupled to the head portion 20. Ideally, the handle has a bore 18 therethrough for hanging the tool on a tool rack. The bore 18 is substantially adjacent to the distal end 14 of the handle and is generally annular.

The head portion 20 comprises a first portion 22 and a second portion 30. The first portion has a first side 24 and a second side 26. The first side 24 of the first portion is fixedly coupled to the proximal end 16 of the handle portion. The second end 26 of the first portion has a planar face such that the plain of the planar face is generally perpendicular to a longitudinal axis of the handle portion 12.

A first notch 28 for receiving a drive worm screw 50 is located in the planar face of the first portion 22 of the head portion. The first notch is generally rectangular.

The second portion 30 of the wrench comprises a base 32, a movable jaw 34 and a fixed jaw 36. The base 32 has a first end 38 and second end 39. The first end 38 of the base is fixedly coupled to the second end 26 of the first portion of the head portion. The first end 38 of the base has a second notch 40 therein such that the first 38 and second notches 40 face each other to define an opening through the head.

The fixed jaw 36 is fixedly coupled to the second end 39 of the base. The fixed jaw 36 extends away from the second end of the base and away from the handle 12.

A guide slot 42 defines a track for the movable jaw 36. The guide slot 42 is in the base 32 and extends into the second notch 40. The guide slot 42 is oriented generally parallel to the planar face of the first portion 22 of the head.

The movable jaw 34 has a bottom member 44 thereon adapted to be inserted into the guide slot 42 such that the movable jaw has a top portion extending away from the base. The bottom member 44 of the movable jaw has V-shaped recesses therein. The V-shaped recesses are directed toward the first notch 28.

A drive worm screw 50 for adjusting the distance between the fixed jaw 34 and the movable jaw is rotatably mounted in the first notch. The drive worm screw has a longitudinal axis oriented generally parallel to the face of the first portion 22 of the head portion. The drive worm screw 50 has a width larger than a depth of the first notch 28 such that a peripheral edge of the drive worm screw extends into the second notch 40. The V-shaped recesses are directed toward and in contact with the drive worm screw such that rotating the drive worm screw moves the bottom member 44 within the guide slot.

The distance between the fixed jaw 36 and the movable jaw 34 is altered by rotation of the drive worm screw 50.

The fixed jaw 36 and the movable jaw 34 each have an inner surface 52, 53 defined by sides of the jaws which face each other. The inner surfaces are concave such that when the movable jaw 34 is brought to a location generally adjacent to the fixed jaw 36 a generally annular bore is defined. More specifically, the fixed jaw and the adjustable jaw each have a concave arcuate inner surface 52, 53. The arcuate inner surface 52 of the fixed jaw is oriented in an opposed relationship to the arcuate inner surface 53 of the adjustable jaw. The arcuate inner surface 52 of the fixed jaw extends between an inner end 60 and an outer end 61. The arcuate inner surface 53 of the adjustable jaw extends between an inner end 62 and an outer end 63. The inner end 60, 62 of the arcuate inner surfaces of each of the jaws is located closer to the longitudinal axis 13 than the outer ends 61, 63 of the arcuate inner surfaces of the jaws such that the arcuate inner surfaces open outwardly away from the handle portion.

In use, the tool 10 is placed over a door hinge 54. A wedge is placed between the door and the door jam to place the door in correct alignment with the doorframe. The pin 56 of the hinge is removed so that the pin is only in one of the brackets 58 of the hinge. The other brackets are then bent into alignment with the bracket which still has the pin within it. This is done be turning the drive worm screw 50 to tighten the tool head around the other brackets and then exerting force on the handle 12 to direct the bracket in the direction it needs to be moved. The pin is then reinserted into all of brackets of the hinge.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An adjustable door hinge adjustment system, comprising:

an elongate handle portion and a wrench head portion, the handle and wrench head portions having a longitudinal axis;

said handle portion having a distal end and a proximal end, wherein said proximal end is couple to said head portion;

said wrench head portion comprising:

a base;

a movable jaw;

a fixed jaw coupled to said base, said fixed jaw extending in a direction away from said handle, a guide slot to define a track for said movable jaw, said guide slot being formed in said base;

wherein said movable jaw has a bottom section inserted into said guide slot such that said movable jaw has a top portion extending away from said base;

a notch being formed in said head portion, said notch being in communication with said guide slot;

a drive worm screw being ratably mounted in said notch, said drive worm screw engaging the bottom section of said movable jaw, said drive worm screw being adapted to move said movable jaw along said guide slot upon rotation of said drive worm screw;

said fixed jaw and said adjustable jaw each having a concave arcuate inner surface, the arcuate inner surface of said fixed jaw being oriented in an opposed relationship to the arcuate inner surface of the adjustable jaw, the arcuate inner surface of said fixed jaw extending between an inner end and an outer end, the arcuate inner surface of said adjustable jaw extending between an inner end and an outer end, the inner ends of said arcuate inner surfaces of each of said jaws being located closer together than the outer ends of said arcuate inner surfaces of said jaws at all positions of said adjustable jaw such that the arcuate inner surfaces open outwardly away from said handle portion.

* * * * *